United States Patent [19]

Teichmann

[11] 4,231,722

[45] Nov. 4, 1980

[54] MAGNETIC RECIPROCATING PUMP FOR PUMPING FLUIDS

[76] Inventor: Joachim Teichmann, No. 21 - 5, Auf dem Backenberg, 4630 Bochum 1, Fed. Rep. of Germany

[21] Appl. No.: 888,100

[22] Filed: Mar. 20, 1978

[30] Foreign Application Priority Data

Mar. 22, 1977 [DE] Fed. Rep. of Germany ..... 2712552

[51] Int. Cl.[3] ..... F04B 35/04

[52] U.S. Cl. ..... 417/418

[58] Field of Search ..... 417/410, 415, 416, 417, 417/418, 420, 534; 192/84 PM

[56] References Cited

U.S. PATENT DOCUMENTS

| | | | |
|---|---|---|---|
| 461,295 | 10/1891 | Van Depoele | 417/418 |
| 2,686,280 | 8/1954 | Strong et al. | 417/418 X |

OTHER PUBLICATIONS

"Circulating Pump for High Pressure and −200° to +400° C. Application", The Review of Scientific Instruments, vol. 41, No. 10, pp. 1444–1446, Oct. 1970.

*Primary Examiner*—Carlton R. Croyle

*Assistant Examiner*—Edward Look

*Attorney, Agent, or Firm*—John C. Smith, Jr.

[57] ABSTRACT

A magnetic reciprocating pump for pumping fluids, i.e. gases or liquids, with high pressures and at high temperatures is provided. The pump has a piston freely movable in a tube of non-magnetic material and provided with recesses for the fluid to be pumped. A ball valve is provided in the piston and in one end of the non-magnetic tube. The drive force on the piston is transmitted by permanent ring magnets arranged outside of the non-magnetic tube, said ring magnets being reciprocated by a thrust rod driven by an electric motor. The balls of the valves are of steel and for sealing the high pressure system metal rings are provided. Connecting rods connect the peripheral body of the pump containing the magnets to the peripheral body of a magnetic coupling the core piece of which is arranged freely movable in a sealingly closed guide tube and is made up of axially magnetized permanent ring magnets. The magnets are secured to an arbor connected to the thrust rod. The peripheral body of the magnetic coupling has the same number of fixedly arranged, axially magnetized ring magnets as the core piece.

24 Claims, 6 Drawing Figures

MAGNETIC RECIPROCATING PUMP FOR PUMPING FLUIDS

BACKGROUND OF THE INVENTION

This invention relates to a magnetic reciprocating pump for pumping fluids, i.e. gases or liquids, with high pressures and at high temperatures, the pump having a piston freely movable in a tube of non-magnetic material and provided with recesses for the fluid to be pumped, a ball valve each being provided in the piston and in one end of the non-magnetic tube, and the drive force on the piston being transmitted by permanent ring magnets arranged outside of the non-magnetic tube, said ring magnets being reciprocated by a thrust rod driven by an electric motor.

Such a pump is known, cf. "The Review of Scientific Instruments", volume 41, No. 10, 1444–1446, October 1970. This pump can be employed only for temperatures of up to 200° C., however, since the balls used there for the inlet and outlet valves are made of polytetrafluoroethylene (Teflon) which suffers from plastic deformations already at temperatures of about 200° C. and moderately high pressures, the leak-proofness of the pump system thereby not being assured any more. Furthermore with this conventional pump system the passage for the thrust rod into the heated thermostat for driving the ring magnets is possible only with a high structural expense, the frictional losses occuring at the seal causing an extra load and a premature wear of the seal for the electrical drive system.

SUMMARY OF THE INVENTION

It is the object of the present invention to provide a magnetic pump which operates at temperatures of up to 300° C. and pressures of up to 700 bar continuously and is subject to no wear and permits its use also for aggressive fluids.

To attain this object the present invention provides a magnetic reciprocating pump for pumping fluids, i.e. gases or liquids, with high pressures and at high temperatures, the pump having a piston freely movable in a tube of non-magnetic material and provided with recesses for the fluid to be pumped, a ball valve each being provided in the piston and in one end of the non-magnetic tube, and the drive force on the piston being transmitted by permanent ring magnets arranged outside of the non-magnetic tube, said ring magnets being reciprocated by a thrust rod driven by an electric motor, wherein the balls of the valves are of steel and for sealing the high pressure system metal rings are provided and connecting rods connect the peripheral body of the pump containing the magnets to the peripheral body of a magnetic coupling the core piece of which is arranged freely movable in a sealingly closed guide tube and is made up of axially magnetized permanent ring magnets which are secured to an arbor connected to the thrust rod, the peripheral body of the magnetic coupling having the same number of fixedly arranged, axially magnetized ring magnets as the core piece.

BRIEF DESCRIPTION OF THE DRAWINGS

Embodiments of the invention will now be described by way of example and with reference to the accompanying drawings, in which.

DESCRIPTION OF THE PREFERRED EMBODIMENTS

Figure 1:
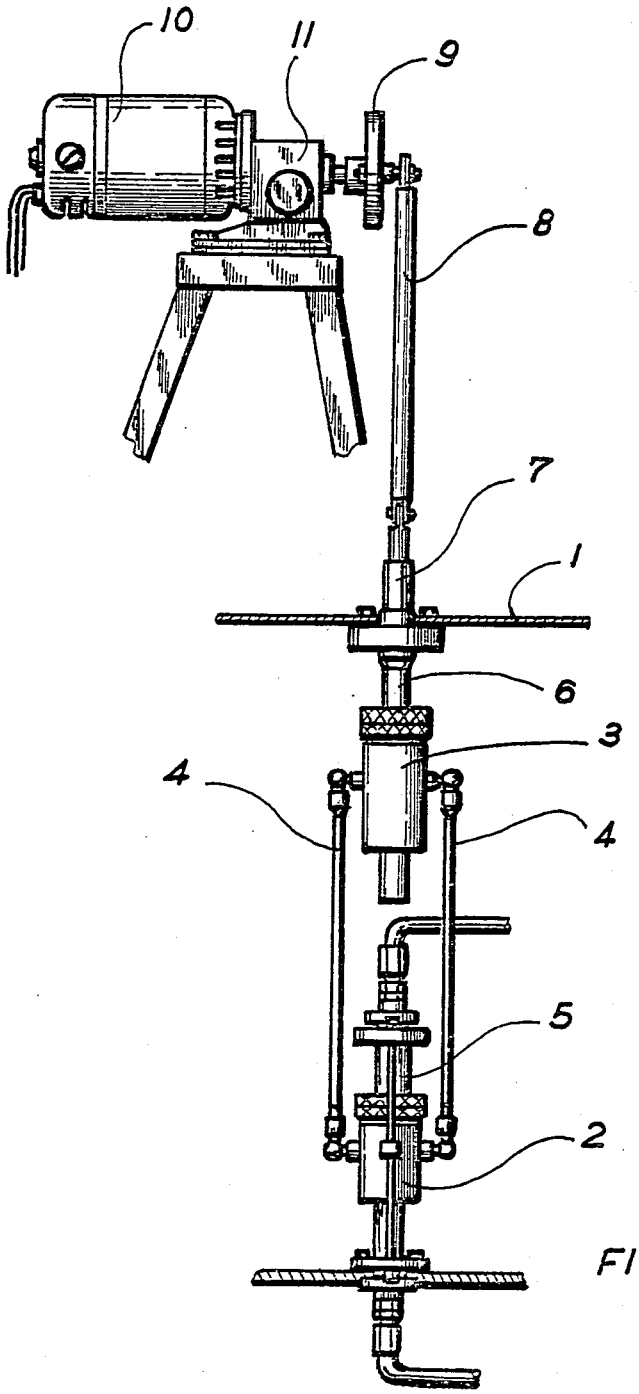
FIG. 1 is a diagram of the pump system, the pump being arranged in a heated thermostat exposed to the pressure of a fluid.

With reference now to FIG. 1, in a thermostat 1 subjected to the pressure of a fluid—for instance a liguid—, the walls of the casing of which are illustrated only partially, there are arranged a reciprocating pump 2 enclosed in a peripheral body 2*a* (FIG. 3) and a magnetic coupling 3 transmitting axial motions. The magnetic coupling 3 is enclosed in a peripheral body 3*a* (FIG. 2) connected via two connecting rods 4 to the peripheral body 2*a* of the pump 2 so that this peripheral body 2*a* follows the motions of the peripheral body 3*a* of the coupling 3 and in doing so slides along a pump tube 5.

The magnetic coupling 3 has a core piece 31 arranged slidable in a guide tube 6 of non-magnetic material which is sealingly connected to the walls of the casing of the thermostat 1. The core piece 3*i* is coupled via a thrust rod 7 and a connecting rod 8 to a cam 9 which is rotated by a controllable d.c. motor 10 via a transmission 11. The axial motions of the thrust rod 7 are transmitted from the core piece 3*i* connected to the thrust rods 7 by means of permanent magnets to the peripheral body 3*a*.

Figure 2:
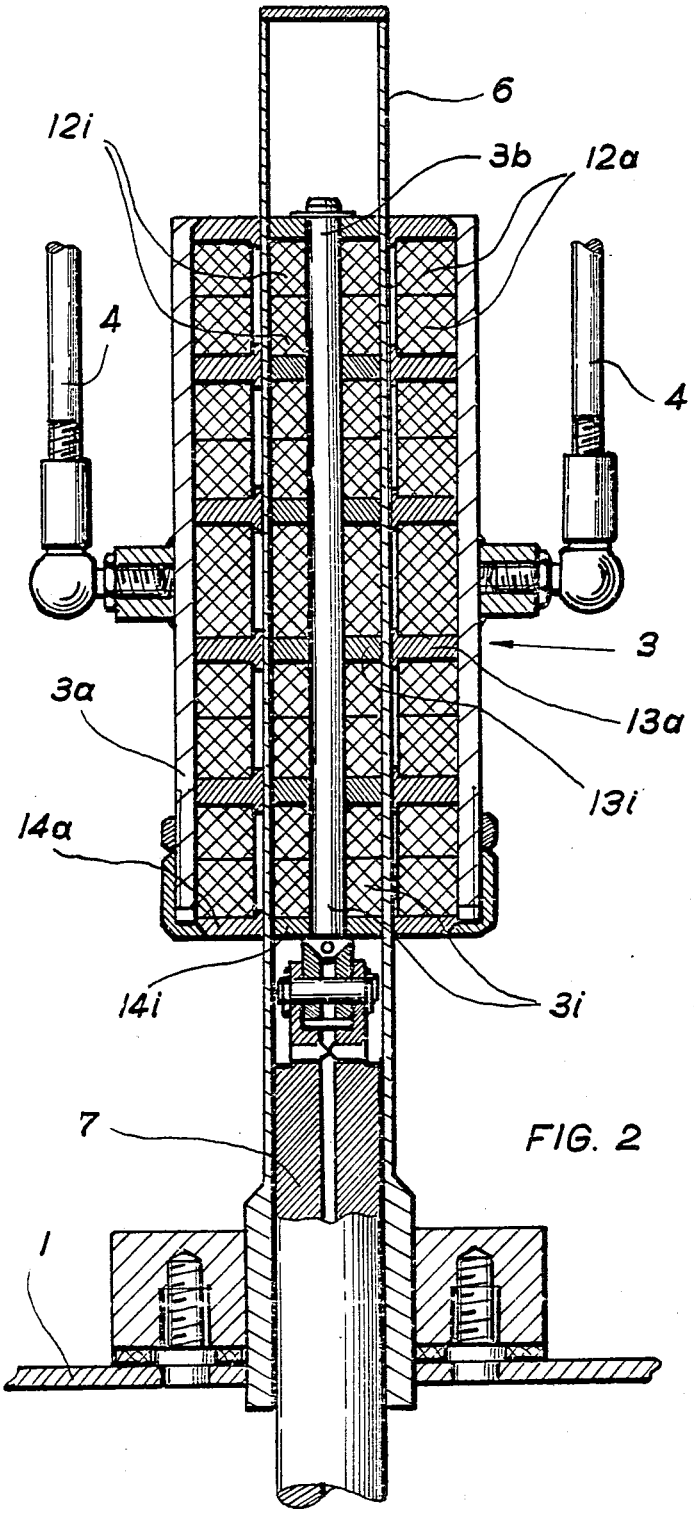
FIG. 2 shows the magnetic coupling which permits a transmission of the reciprocating drive motion to the pump.

The structure of the magnetic coupling 3 is illustrated in FIG. 2. On the core piece 3*i* positioned slidable in the guide tube 6 of non-magnetic material and on the peripheral body 3*a* arranged slidable externally of the guide tube 6, there are provided an equal number of axially magnetized ring magnets 12*i* and 12*a*, respectively. A separating disc 13*a* and 13*i*, respectively follows two magnets each, said separating disc being of soft-magnetizable material. The magnets of the core piece 3*i* together with the associated separating discs are positioned between end plates 14*i* on an arbor 3*b* connected to the thrust rod 7, while the corresponding magnet system of the peripheral body 3*a* is likewise closed by end plates 14*a* with which the connecting rods 4 engage.

The faces of the magnets adjacent to the separating discs are of the same polarity, but in the peripheral body 3*a* opposite to the polarity of the magnets of the core piece 3*i*. Thereby, a high magnetic flux and thus a high coupling force are achieved. Furthermore, the coupling remains stable in the event of shock loads.

Figure 3:
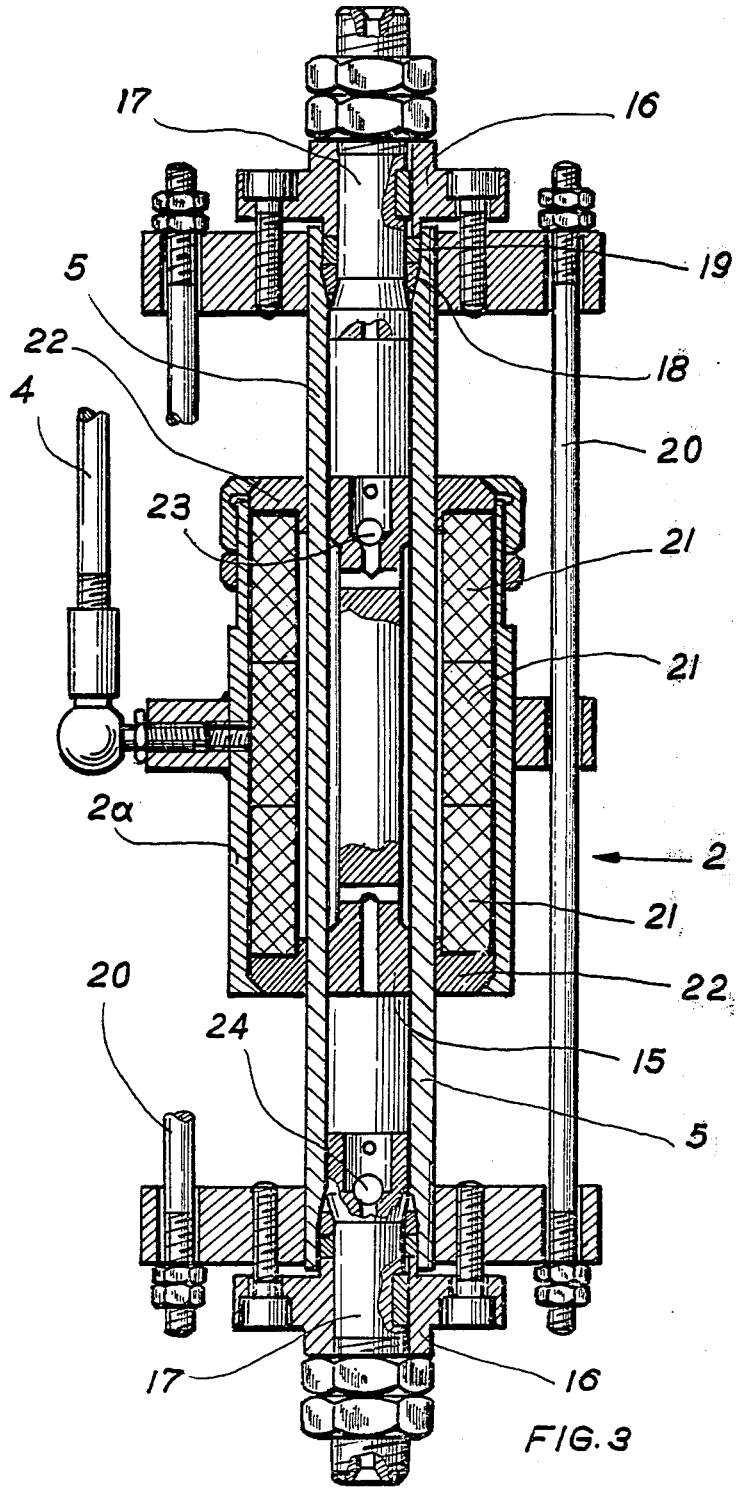
FIG. 3 shows the pump.

The structure of the pump 2 is illustrated in FIG. 3. The pump tube 5 of non-magnetic material separates the peripheral body 2*a* of the pump 2 from the pump piston 15. Since the pump tube 5 internally is subject to high pressure, it must be rated to cope with the high thermal and mechanical loads. The pump tube 5 is connected at both ends by means of pressure plates 16 via tubular end pieces 17 to a high pressure system. The sealing of the high pressure system in relationship to the thermostat 1 is assured by metal rings 18. They have a taper angle of 15° inwardly and outwardly and are urged by pressure rings 19 to the internal surface of the pump tube 5 inclined by 12° at the seal location and to the external surface of the tubular end pieces 17. As a result of the different taper of the seal surfaces, the contact surface is very small, and the seal action is accordingly satisfactory for a predetermined tightening force.

Subject to the thrust action of the connecting rods 4, the peripheral body 2*a* of the magnetic pump 2—secured against rotation by two guide rods 20—slidingly reciprocates. Three axially magnetized ring magnets 21 of opposite polarity are clamped between two pole shoes 22 in the peripheral body 2*a*, which are of such a configuration that they enhance the path of the magnetic field into the interior of the pump tube 5, where the pump piston 15 consisting of well magnetizable material is arranged freely movable and defines a magnetic shunt for the magnetic field of the ring magnets. Depending on the motions of the peripheral body 2*a*, the piston 15 reciprocates. It is provided with bores and recesses and with a ball valve 23 at one end in order to permit the passage and the pumping of the fluid. A second ball valve 24 operating in countersense at the tubular end piece for the fluid inlet prevents a reflowing of the fluid upon a return motion of the piston 15. The balls of the two ball valves 23 and 24 consist of non-magnetic high-alloy steel.

Upon movement of the piston 15 in the direction toward the magnetic coupling 3 the valve 23 shuts, and the fluid upstream of this valve is continued to be pumped through the tubular end piece while the valve 24 opens, so that fluid is able to continue to flow. When the piston moves in the opposite direction, the valves operate reverse so that the fluid getting upstream of the valve 24 is able to flow through recesses in the piston and the valve 23. The pump thus pumps once for each back and forth motion.

Figure 4:
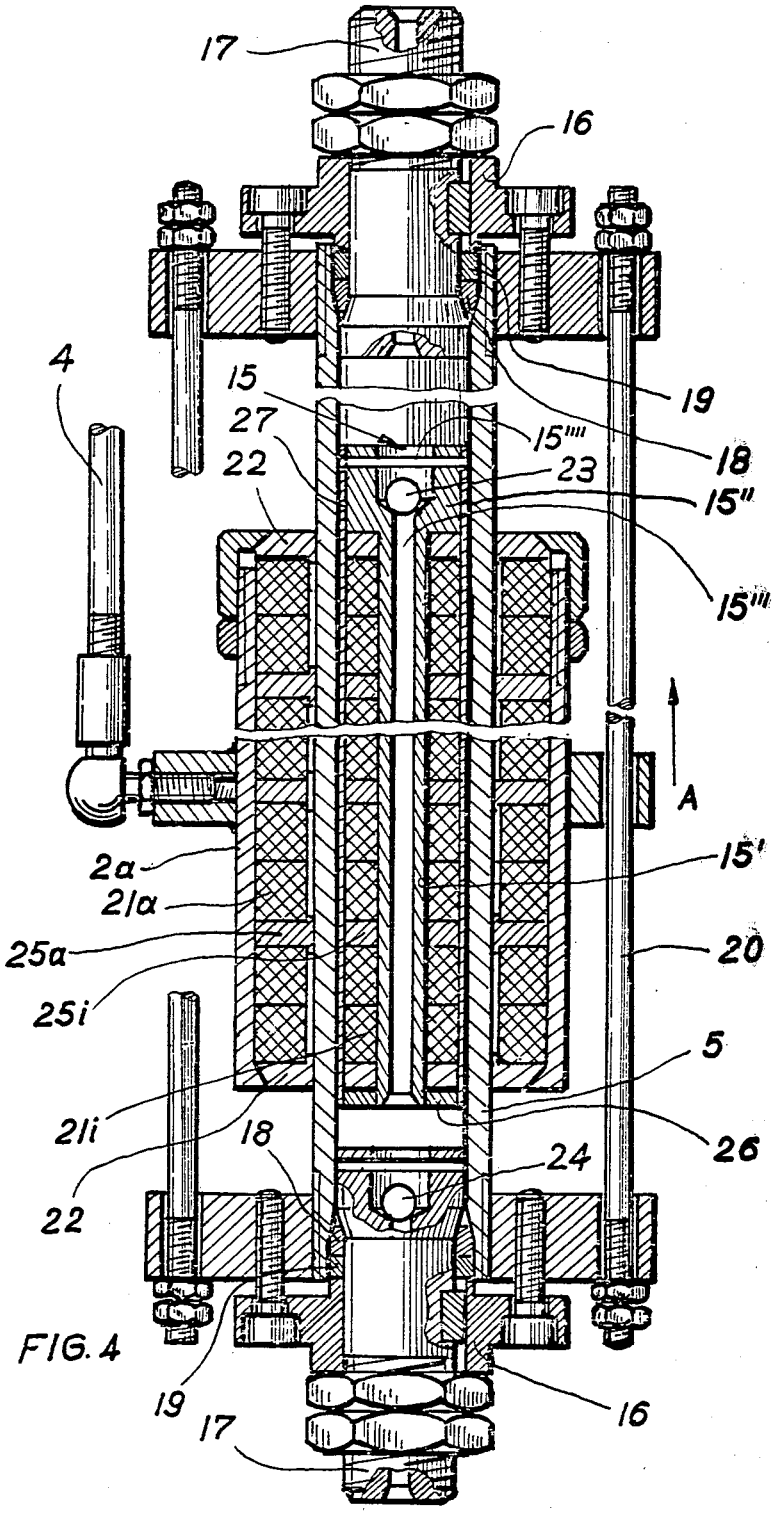
FIG. 4 shows a further embodiment of the pump.

In the embodiment according to FIG. 4, a longitudinal bore 15''' for the fluid to be pumped is provided in the central arbor 15' of the piston 15, and therein a ball valve 23 is provided in an enlargement 15'''' of the bore, namely in the thickened end 15'' of the arbor. Furthermore, at the inner end of the oppositely positioned tubular end piece 17, a ball valve 24 acting in countersense is provided. Between the arbor 15' and a cylindrical sleeve 27 of non-magnetic material arranged slidable in the pump tube 5 and being closed (in the drawing) at the top by the thickened end 15'' of the arbor 15' and at the bottom by an end plate 26, likewise of non-magnetic material, there are accommodated internal permanent ring magnets 21*i* and separating rings 25*i* of soft-magnetic material, hermetically sealed, in the same number and height as the permanent ring magents 21*a* and separating rings 25*a* fixed in the peripheral body 2*a*. The faces of the permanent magnets adjacent to the separating discs are of the same polarity, but in the peripheral body opposite to the polarity of the permanent magents of the freely movable piston 15.

When the piston moves in direction of the arrow A indicated in FIG. 4, the ball valve 23 is shut, and the fluid downstream of this valve is continued to be pumped through the tubular end piece, while the valve 24 opens, so that fluid is able to continue to flow in. When the piston moves in the opposite direction, the valves operate in reverse so that the fluid downstream of the valve 24 is able to flow through the bore 15''' of the pump piston 15 and the valve 23 thereof. The pump thus pumps once for each combined back and forth motion.

Figures 5, 6:
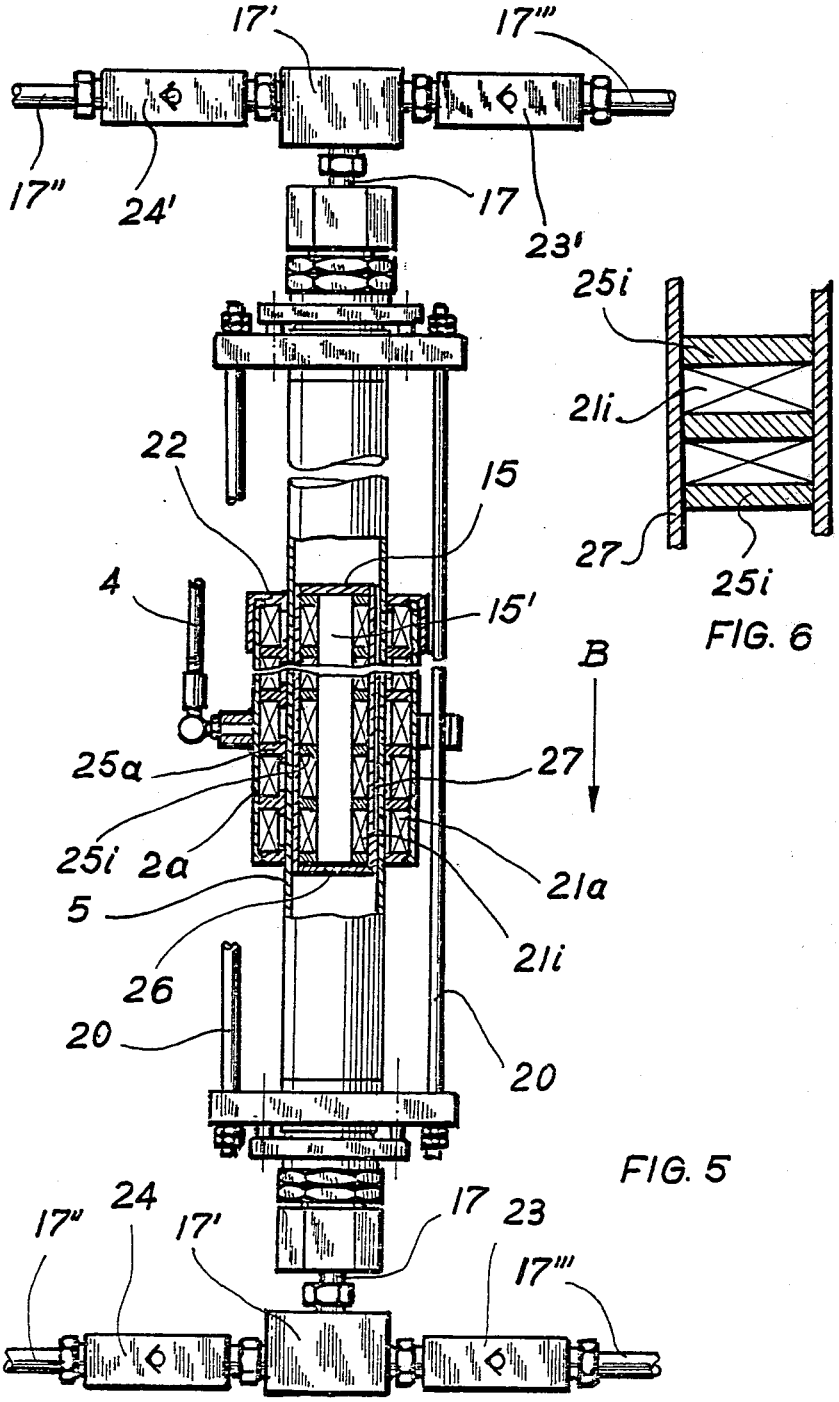
FIG. 5 shows a pump in a double-acting embodiment with four ball valves arranged externally.
FIG. 6 is a fragmentary cross section of an embodiment of a pump piston according to FIG. 5.

In FIG. 5, a double-acting magnetic reciprocating pump is illustrated. In this case, the internal permanent ring magnets 21*i* and separating rings 25*i* of the pump piston 15 are accommodated hermetically sealed in a cylindrical sleeve 27 of non-magnetic material which is axially closed by two end plates 26 likewise of non-magnetic material and are rigidly interconnected by a central arbor 15'. Two conduit pieces 17'' and 17''' of the high pressure system are connected to the two tubular end pieces 17 by means of a tee-shaped branch member 17', each, in which conduit pieces one ball valve 24, 23 and 24', 23', respectively, is provided each operating in countersense to the other.

When the piston 15 moves in the indicated arrow direction B by a sliding of the peripheral body 2*a*, the valves 24 and 23' are shut, and the fluid downstream of the piston is pumped through the valve 23, at the same time further fluid flowing in through the valve 24'. When the movement is in the opposite direction, the opposite pump action results, i.e. the valves 23 and 24' are shut, and fluid is pumped by the piston through the open valve 23' into the pressure line, at the same time further fluid flowing in through the open valve 24.

In FIG. 6, a modified embodiment of the pump piston 15 including disc-shaped permanent magnets 21*i* and separating discs 25*i* within the sleeve is illustrated, which are firmly connected together with the end plates 26.

The invention may be embodied in other specific forms without departing from the spirit or the essential characteristics thereof. The embodiments therefore are to be considered in all respects as illustrative and not restrictive.

What is claimed is:

1. A magnetic reciprocating pump for pumping fluids at high pressures and temperatures comprising:

(a) a tube of nonmagnetic material connected at opposite ends respectively to fluid conduit means;

(b) a piston freely reciprocable in said tube and comprising core magnetic means;

(c) one-way valve means for controlling flow of fluid through said conduit means during reciprocation of said piston;

(d) external magnetic means arranged about said tube; and (e) means for reciprocating said external magnetic means along a path substantially parallel to said tube;

(f) said external magnetic means comprising a plurality of peripheral permanent ring magnets, said core magnetic means comprising a plurality of axially magnetized core permanent ring magnets, the number of external and internal permanent ring magnets being equal and said external permanent ring magnets surrounding said tube of nonmagnetic material;

(g) whereby reciprocation of said external magnetic means by said drive means causes said piston to reciprocate within said tube, pumping fluid through said one-way valve means and conduit means.

2. A pump as set forth in claim 1 wherein said drive means comprises a motor and a thrust rod extending to said external magnetic means for reciprocating said external magnetic means.

3. A pump as set forth in claim 1 wherein a separating disc of soft magnetizable material follows two peripheral permanent ring magnets each, the faces of the magnets adjacent to the separating discs being of the same polarity, but in the peripheral permanent ring magnets, opposite to the polarity of the permanent ring magnets of the core.

4. A pump as set forth in claim 1, wherein the pump piston is of non-magnetic material, carries the same number of axially magnetized core permanent magnets of the same height and of disc or ring shape and has a hermetically sealing cylindrical sleeve of non-magnetic material arranged slidable in the pump tube and closed at both axial ends.

5. A pump as set forth in claim 4, wherein between respectively two core permanent magnets there is arranged one separating ring or one separating disc of soft magnetizable material, the faces of the core permanent magnets adjacent to the separating rings or separating discs being of the same polarity, but in the peripheral permanent ring magnets of the pump, opposite to the polarity of the core permanent magnets of the pump piston.

6. A pump as set forth in claim 5, wherein the permanent magnets are composed of several rings or discs which have opposite poles at their engagement locations.

7. A pump as set forth in claim 5, wherein the separating rings or separating discs are composed of several discs or rings.

8. A pump as set forth in claim 5, wherein the number of ring magnets and of the separating rings or separating discs is selected depending on the required force and stability of the coupling, the length of the peripheral body of the pump and of the pump piston thereby resulting.

9. A pump as set forth in claim 5, wherein the pump piston contains a central arbor by means of which the permanent ring magnets and separating rings are axially clamped together by means of a thickened end, an end plate likewise of a non-magnetic material or by means of two such end plates.

10. A pump as set forth in claim 9, wherein in the central arbor of said pump piston there is a longitudinal bore for the fluid to be pumped and a ball valve in a thickened end, while another ball valve is arranged at the inner end of an oppositely disposed tubular end piece.

11. A pump as set forth in claim 5, wherein non-hermetically sealed portions of the permanent magnets and separating rings are provided with a coating protecting against corrosion by the fluid.

12. A pump as set forth in claim 4, wherein the pump piston contains permanent disc magnets and separating discs as well as two end plates which are firmly interconnected within the sleeve.

13. A pump as set forth in claim 1, wherein two conduit pieces of a high pressure system each are connected to the opposite ends of said tube by means of a tee-shaped branch member, in which conduit pieces there is provided one of said one-way valve means, each operating in a countersense to the other.

14. A pump as set forth in claim 13, wherein a separating disc of soft magnetizable material follows two ring magnets each, the faces of the magnets adjacent to the separating discs being of the same polarity, but in the peripheral magnets, opposite to the polarity of the magnets of the core magnets.

15. A pump as set forth in claim 13, wherein the pump piston is of non-magnetic material, carries the same number of axially magnetized permanent magnets of the same height and of disc or ring shape and has a hermetically sealing cylindrical sleeve of non-magnetic material arranged slidable in the pump tube and closed at both axial ends.

16. A pump as set forth in claim 15, wherein between respectively two permanent magnets there is arranged one separating ring or one separating disc of soft magnetizable material, the faces of the permanent magnets adjacent to the separating rings or separating discs being of the same polarity, but in the peripheral permanent ring magnets, of the pump opposite to the polarity of the magnets of the pump piston.

17. A pump as set forth in claim 16, wherein the permanent magnets are composed of several rings or discs which have opposite poles at their engagement locations.

18. A pump as set forth in claim 16, wherein the separating rings or separating discs are composed of several discs or rings.

19. A pump as set forth in claim 16, wherein the number of ring magnets and of the separating rings or separating discs is selected depending on the required force and stability of the coupling, the length of the peripheral body of the pump and of the pump piston thereby resulting.

20. A pump as set forth in claim 16, wherein the pump piston contains a central arbor by means of which the permanent ring magnets and separating rings are axially clamped together by means of a thickened end, an end plate likewise of a non-magnetic material or by means of two such end plates.

21. A pump as set forth in claim 16, wherein the pump piston contains permanent disc magnets and separating discs as well as two end plates which are firmly interconnected within the sleeve.

22. A pump as set forth in claim 13, wherein the peripheral body of the pump is secured against rotation in relationship to the pump tube by at least two longitudinal guide rods.

23. A pump as set forth in claim 13, wherein the non-hermetically sealed portions of the permanent magnets and separating rings are provided with a coating protecting against corrosion by the fluid.

24. A pump as set forth in claim 1, wherein the peripheral permanent ring magnets of the pump are secured against rotation in relationship to the pump tube by at least two longitudinal guide rods.

* * * * *